US006023787A

United States Patent [19]

French et al.

[11] Patent Number: 6,023,787

[45] Date of Patent: Feb. 15, 2000

[54] HOOD WITH FACEGUARD

[76] Inventors: Katherina Grace French, 38020 WCR 45, Eaton, Colo. 80615; Dianna Lynn Benson, 6714 E. Amherst Ct., Highlands Ranch, Colo. 80126; Natalie Rhene Vandevuss, 6714 E. Amherst Ct., Highlands Ranch, Colo. 80126; Scott Anthony Benson, 6714 E. Amherst Ct., Highlands Ranch, Colo. 80126

[21] Appl. No.: 09/225,763

[22] Filed: Jan. 5, 1999

Related U.S. Application Data

[60] Provisional application No. 60/099,638, Sep. 9, 1998.

[51] Int. Cl.[7] ..... A42B 1/04

[52] U.S. Cl. ..... 2/202; 2/204; 2/424; 2/173

[58] Field of Search ..... 2/195.1, 195.2, 2/202, 417, 418, 419, 424, 204, 173

[56] References Cited

U.S. PATENT DOCUMENTS

| | | | |
|---|---|---|---|
| 1,097,530 | 5/1914 | Cabelinsky . | |
| 2,500,982 | 3/1950 | Fligel | 2/84 |
| 2,839,757 | 6/1958 | Gianola | 2/205 |
| 4,300,240 | 11/1981 | Edwards | 2/206 |
| 4,768,235 | 9/1988 | Webster | 2/205 |
| 5,214,804 | 6/1993 | Carey et al. | 2/206 |
| 5,251,336 | 10/1993 | Nevins | 2/202 |
| 5,704,068 | 1/1998 | Martin | 2/173 |
| 5,765,230 | 6/1998 | Sivret et al. | 2/202 |
| 5,832,538 | 11/1998 | Williams | 2/202 |

*Primary Examiner*—Diana Oleksa

*Attorney, Agent, or Firm*—Patent Law Offices of Rick Martin, P.C.

[57] ABSTRACT

The present invention is a hood with faceguard and visor for protecting a user from cold or inclement weather. It comprises a hood with a drawstring and to which a protective facecover is attached. The faceguard is attached to a lower portion of the hood in a tubular fashion. In use, the faceguard is pulled up through the lower portion of the hood which then obverts or turns the faceguard and lower portion "outside in". This places the faceguard in proper alignment for use on a users face within the hood, affording maximum protection for a user from the weather.

An alternate embodiment of the invention comprises a faceguard integrally connected to the hood or cover in a position to align with a user's face upon being donned by a user. In the alternate embodiment, a drawstring is contained within a channel. The channel forms an arc described by a path beginning at a first side of the faceguard, arcing up to a zenith of the hood, and descending to the second side of the faceguard. In the alternate embodiment, a neck-gator is connected to a lower portion of the hood. The gator forms a weather-tight seal between a garment worn by a user and a user's neck and head.

5 Claims, 3 Drawing Sheets

HOOD WITH FACEGUARD

REFERENCE TO RELATED APPLICATIONS

This non-provisional application is a continuation-in-part claiming priority from U.S. Provisional Application No. 60/099,638 filed Sep. 9, 1998.

FIELD OF THE INVENTION

The field of the invention relates to head protection for cold weather, more particularly to hoods having an attached faceguard with neck-gator.

BACKGROUND OF THE INVENTION

Devices to give a user head protection from the weather and sun are well known. Coverings include stocking caps, hoods on coats, touks, scarves and baseball caps. Each individually affords a certain amount of protection for a user. However, prior to the instant invention, a combination of each or all may have been necessary to fully and efficiently protect a user's head and neck from inclement weather.

Representative of the art is:

U.S. Pat. No. 5,765,230-issued Jun. 16, 1998 to Sivret et al, which discloses a multifunction head apparel.

U.S. Pat. No. 5,704,068-issued Jan. 6, 1998 to Martin, discloses a cowl to protect the head, face and neck of an individual.

U.S. Pat. No. 5,251,336 issued Oct. 12, 1993 to Nevins which discloses a head protector for inclement weather which includes a hood having a facial port and a neck portion surrounding a neck channel.

U.S. Pat. No. 5,214,804-issued Jun. 1, 1993 to Carey et al discloses a piece of clothing having a mask member and a scarf member joined together.

U.S. Pat. No. 4,768,235-issued Sep. 6, 1988 to Webster discloses a cold weather mask and hood.

U.S. Pat. No. 4,300,240-issued Nov. 17, 1981 to Edwards discloses a clod weather face mask made from a thin rubber cloth-like material.

U.S. Pat. No. 2,839,757-issued Jun. 24, 1958 to Gianola discloses a head-covering garment.

U.S. Pat. No. 2,500,982-issued Mar. 21, 1950 to Fligel discloses a hooded rain cape.

U.S. Pat. No. 1,097,530-issued May 19, 1914 to Cabelinsky discloses a rain cape to be worn over one's clothing.

What is needed is a hood having an attached faceguard. What is needed is a hood with attached faceguard wherein the faceguard comprises a protective material; such as but not limited to, neoprene. What is needed is a hood with attached faceguard having a visor or screen. What is needed is a hood with attached faceguard having a plurality of drawstrings. What is needed is a hood with attached faceguard also having a neck-gator. What is needed is a hood with attached faceguard having a drawstring, which describes an arc about a user's head. The present invention meets these needs.

SUMMARY OF THE INVENTION

The primary aspect of the present invention is to provide a hood with facecover having an attached faceguard.

Another aspect of the present invention is to provide a hood with facecover having an attached protective facecover.

Another aspect of the present invention is to provide a hood with facecover having a visor or screen.

Another aspect of the present invention is to provide a hood with facecover having a drawstring.

Another aspect of the present invention is to provide a hood with facecover having a drawstring describing an arc about a user's head.

Another aspect of the present invention is to provide a hood with facecover having a neck-gator.

Another aspect of the present invention is to provide a hood with facecover wherein the facecover is an integral part of the hood.

Other aspects of this invention will appear from the following description and appended claims, reference being made to the accompanying drawings forming a part of this specification wherein like reference characters designate corresponding parts in the several views.

The invention comprises an upper portion being a hood or cover. A lower or neck portion in the form of a long sleeve or collar is attached to or comprises an integral part of the lower circumference of the hood. Also attached to the lower portion is a faceguard or facecover. The facecover comprises an insulating waterproof material such as neoprene, which can retain a predetermined shape. In use the lower portion is pulled up through the lower circumference of the hood in order to turn the lower portion inside out. This places the facecover in proper alignment with a users face when the user is wearing the hood. The facecover protects the users lower face and nose from cold and inclement weather. The hood also has a drawstring to adjust the hood opening as required by a user. It also has a drawstring to adjust the size of the lower opening through which a user inserts his or her head.

An alternate embodiment of the invention comprises a faceguard integrally connected to the hood in a position to align with a user's face upon being donned by a user. In the alternate embodiment, a drawstring is contained within a channel. The channel forms or describes an arc described by a path beginning at a first side of the faceguard, arcing up to a zenith of the hood, and descending to the second side of the faceguard. In the alternate embodiment, a neck-gator, or simply "gator", is connected to a lower portion of the hood. The gator forms a weather-tight seal between a garment worn by a user and a user's neck and head and the cover of the invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
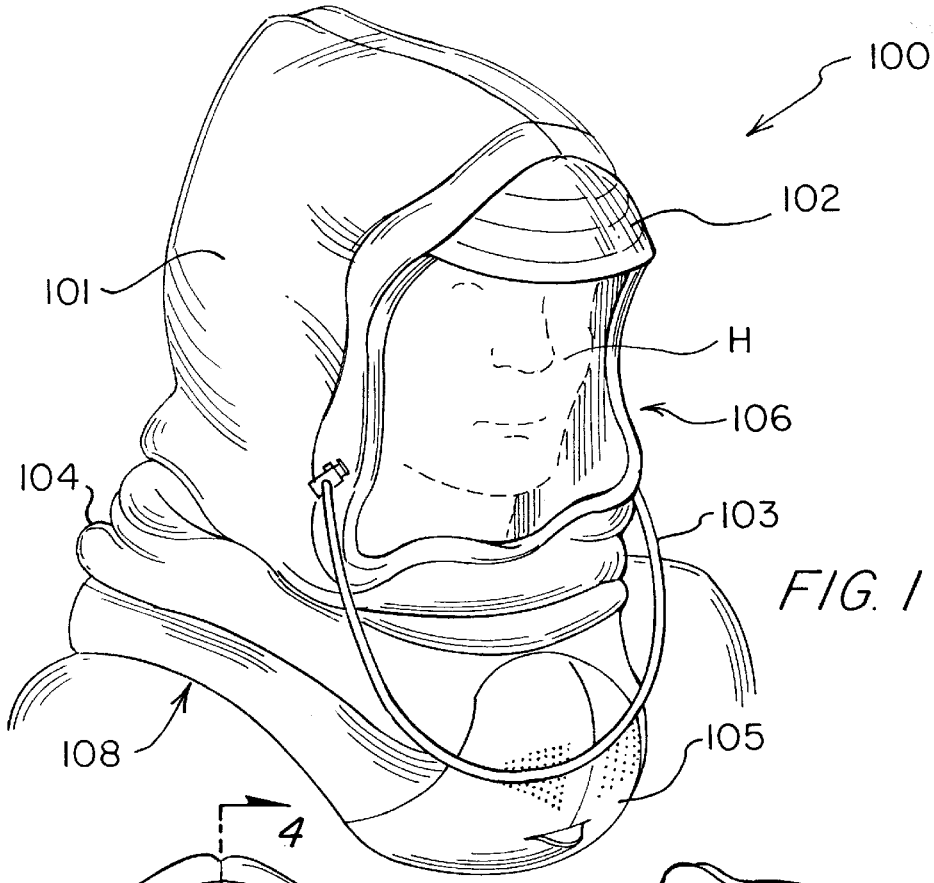
FIG. 1 is a front perspective view of the preferred embodiment of the invention.

FIG. 1 is a front perspective view of the preferred embodiment 100 of the invention. Hood or cover 101 encloses a users head H. Hood or cover 101 is made of a natural or synthetic fiber having good insulating qualities and is used to provide warmth. It may also comprise any water-repellent material to protect a user from snow or rain. The hood may also comprise an inner-insulating layer covered by an outer water-repellent layer. Visor or screen 102 extends beyond an edge of the cover 101 to shield a user's eyes from the sun. Drawstring 103 encircles opening 106 and is used to control the size of opening 106 if a user desires more or less protection from the elements. Neck portion 104 is an integral portion of the invention 100. It is connected directly to and forms a part of cover 101. Neck portion 104 is of a length sufficient to allow it to extend to a users shoulders. Faceguard 105 is connected to and forms an integral part of neck portion 104. When not in use, faceguard 105 hangs down from the bottom of the neck portion 104. Faceguard 105 comprises any natural or synthetic material, which affords insulating properties and/or water repellent properties as well as the ability to retain a predetermined shape. The preferred embodiment faceguard 105 comprises neoprene or other protective material known in the art, and having an insulating liner material such as fleece or cotton. A user's head H is inserted into the preferred embodiment through opening 108.

Figure 2:
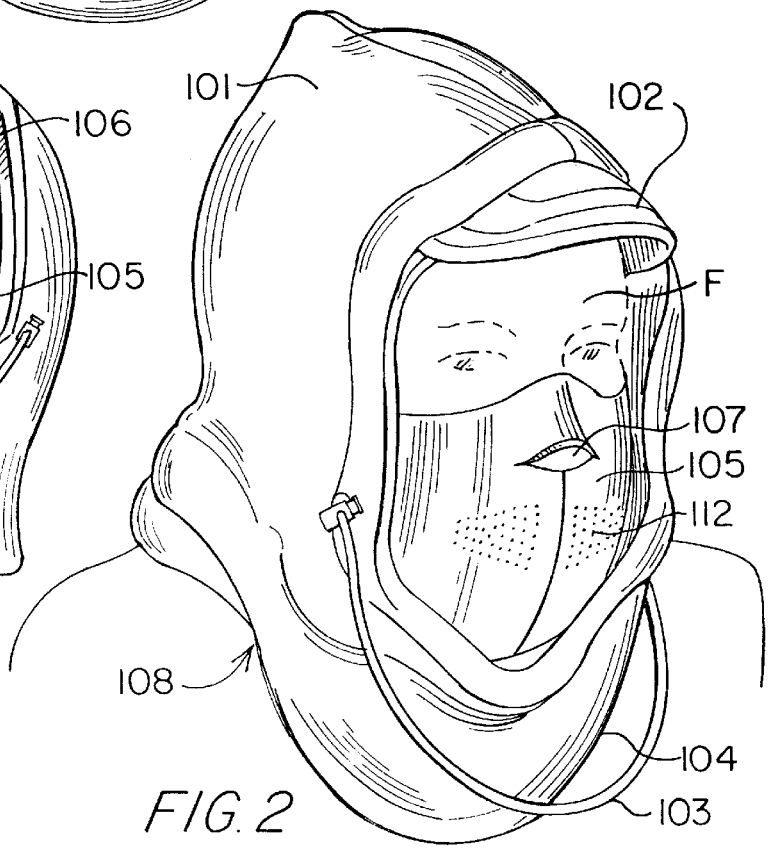
FIG. 2 is a perspective top view of the preferred embodiment showing the faceguard in use.

FIG. 2 is a perspective top view of the preferred embodiment showing the faceguard in use. In use, neck portion 104 is pulled up into hood or cover 101. In doing so, the part of the neck portion 104 which is exterior when the neck portion is extended as shown in FIG. 1, is then "turned outside in" so that the formerly exterior surface is obverted and is now the interior surface and adjacent to a user's face. Faceguard 105 then aligns properly with a users face F. A user breathes through nose opening 107. A user speaks through opening 108.

Figure 3:
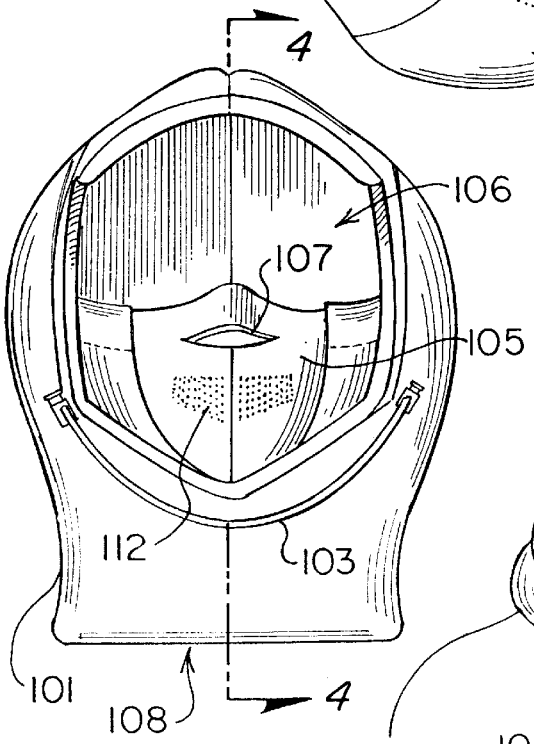
FIG. 3 is a front elevation view of the preferred embodiment.

FIG. 3 is a front elevation view of the preferred embodiment. Faceguard 105 is shown within the cover 101 viewed through opening 106 as described in FIG. 2.

Figure 4:
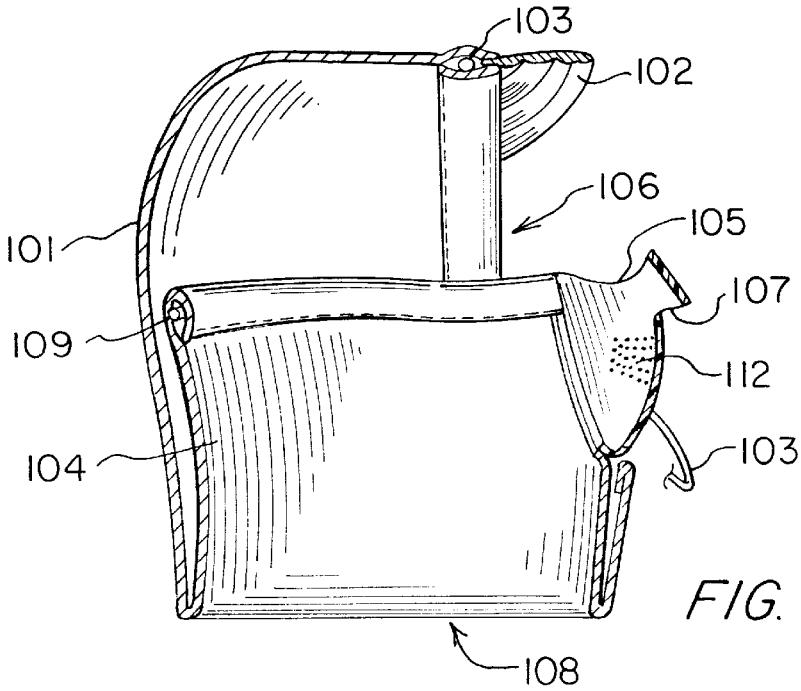
FIG. 4 is a cross-sectional side elevation view taken along line 4—4 in FIG. 3 showing the arrangement of the preferred embodiment.

FIG. 4 is a cross-sectional side elevation view along line 4—4 in FIG. 3 showing the arrangement of the preferred embodiment. Neck portion 104 is shown folded into the cover 101. A user (not shown) inserts his or her head into opening 108 until his or her face aligns with faceguard 105. Drawstring 109 encircles the base of neck portion 104. Drawstring 109 is used to control the size of opening 108.

Figure 5:
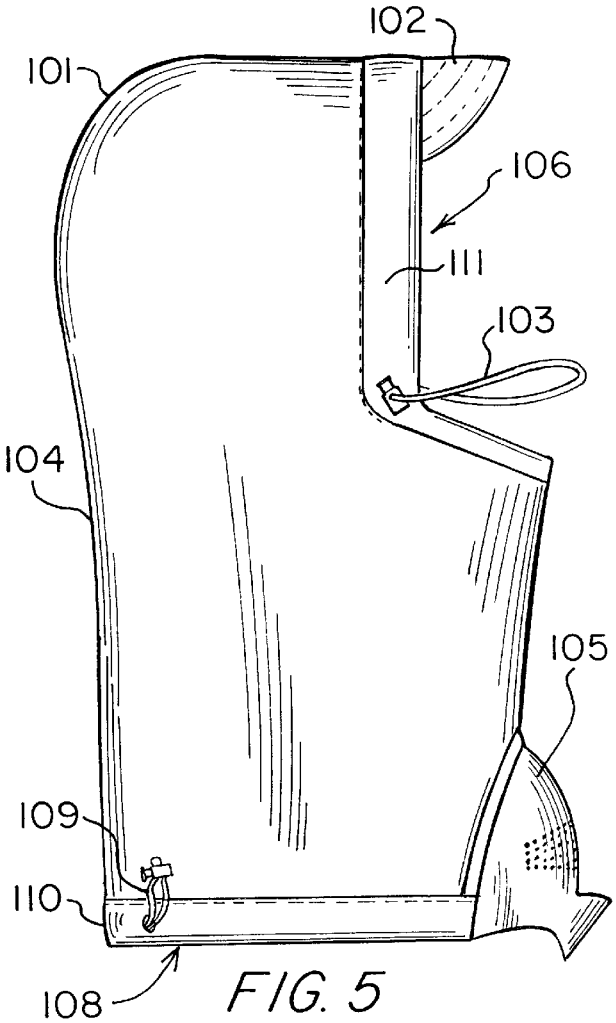
FIG. 5 is a side elevation view of the preferred embodiment.

FIG. 5 is a side elevation view of the preferred embodiment. Neck portion 104 is extended from and below cover 101 when not in use. Drawstring 109 is contained within channel 110 to encircle opening 108. Drawstring 103 is contained within channel 111 to encircle opening 106.

Figure 6:
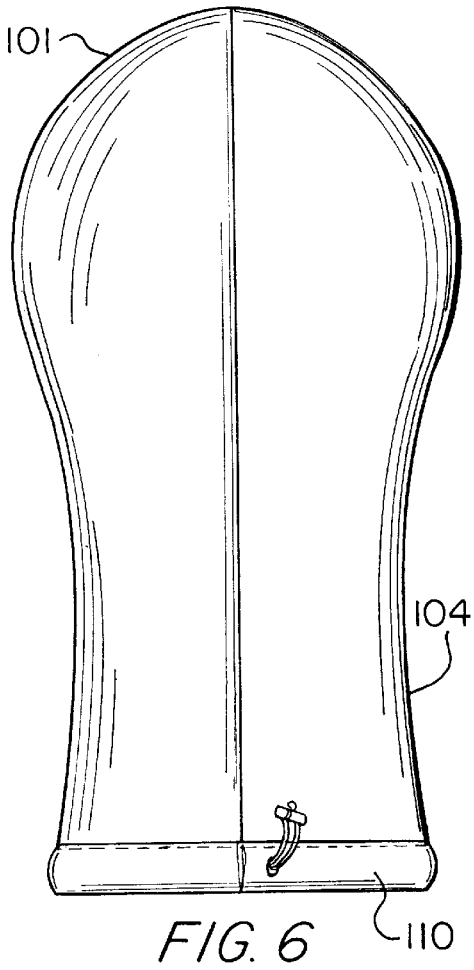
FIG. 6 is a rear elevation view of the preferred embodiment.

FIG. 6 is a rear elevation view of the preferred embodiment. Cover 101 is connected to neck portion 104. In the preferred embodiment, cover 101 and neck portion 104 comprise a single piece of material.

Figure 7:
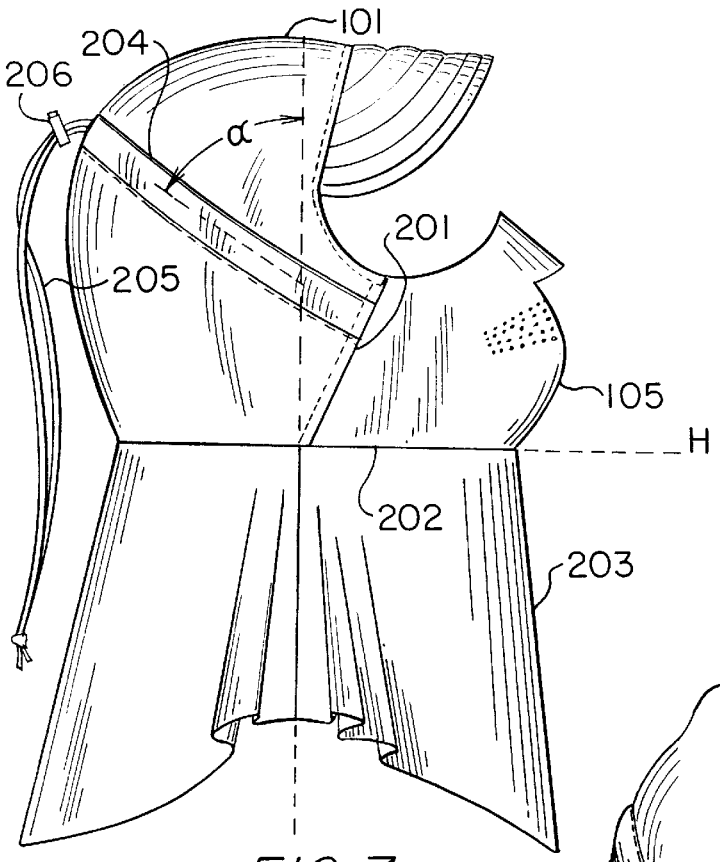
FIG. 7 is a side elevation view of an alternate embodiment.

FIG. 7 is a side elevation view of an alternate embodiment. In this alternate embodiment, faceguard 105 is attached to cover 101 at seams 201 and 202. The seams may be sewn or connected by thermal bonding means known in the art. Neck-gator 203, or simply gator, is attached to the base of cover 101 at seam 202. Seams 202 and 201 are not necessary for realization of the invention and cover 101; faceguard 105 and gator 203 may also be constructed as single piece. Seam 202 runs circumferentially about the base of cover 202 forming a weather tight seal between cover 101 and gator 203. Drawstring 205 is routed in channel 204, which channel 204 describes an acute angle $\alpha$ relative to a vertical axis of the invention, over an upper portion of the cover 101 as compared to a horizontal reference plane H. Drawstring 205 is connected to the faceguard 105 at seam 201. When drawn tight, drawstring 205 retains faceguard 105 snugly adjacent to a user's face. Clamp 206 engages the drawstring 205 to allow drawstring 205 to be held in a predetermined position.

Figure 8:
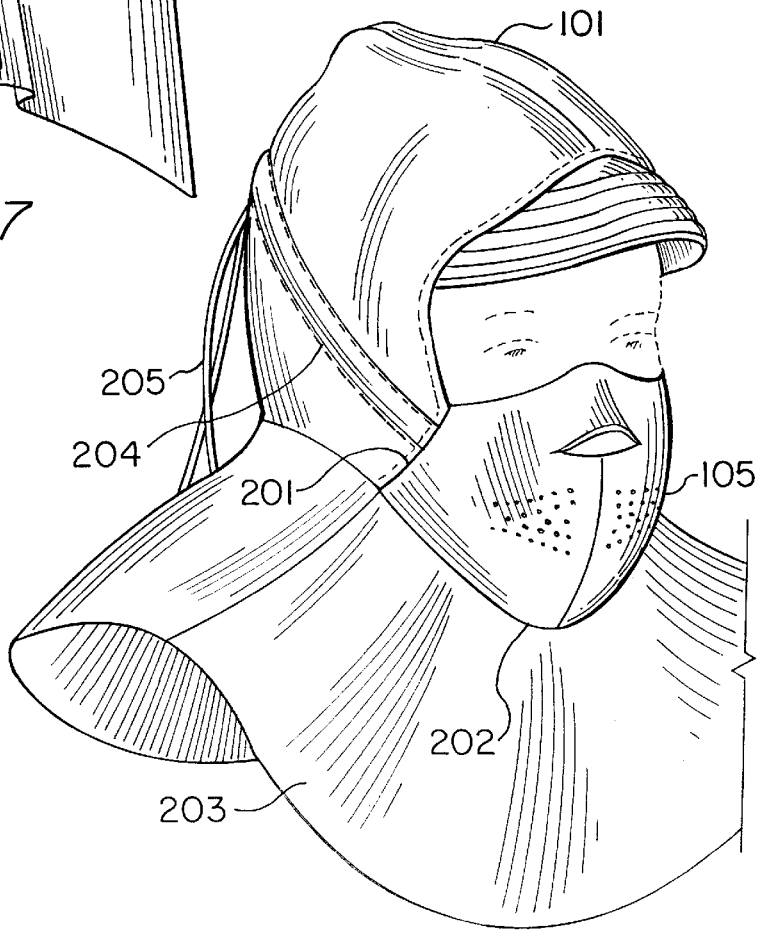
FIG. 8 is a top perspective view of the alternate embodiment of FIG. 7.

FIG. 8 is a top perspective view of an alternate embodiment more fully described in FIG. 7. Gator 203 is of a size sufficient to allow a user to drape gator 203 over his shoulders, thereby forming a closure between a user's neck and any garment or overcoat being worn by a user. This provides enhanced protection from inclement weather and increases the heat retaining capabilities of the invention.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A hood with facecover comprising:

a cover having a lower circumference, an outer surface and a facial opening;

a faceguard connected to said cover within said facial opening so as to align with a user's face;

a gator having a predetermined size and having an edge connected to said lower circumference;

a channel on said outer surface of said cover, said channel describing an arc beginning at a lower first side of said faceguard, and substantially adjacent to said faceguard, said arc describing a path rising about a circumference of said cover to a zenith, said path describing an acute angle with respect to a vertical reference plane, then descending about said cover to a second side of said faceguard, substantially adjacent to said faceguard; and a drawstring contained within said channel whereby said faceguard may be drawn snugly to a user's face through manipulation of said drawstring by a user.

2. The hood with facecover as in claim 1, wherein said facecover further comprises a water repellant material.

3. The hood with facecover as in claim 2, wherein said cover comprises an insulating material.

4. The hood with facecover as in claim 3, wherein said lower portion comprises insulating material.

5. The hood with facecover as in claim 4 further comprising a visor connected to an upper portion of said facial opening.

* * * * *